United States Patent [19]

Precoul et al.

[11] Patent Number: 4,672,896

[45] Date of Patent: Jun. 16, 1987

[54] HOLLOW CHARGES

[75] Inventors: Michel Precoul; Jean S. Peyroux, both of Paris, France

[73] Assignee: Societe d'Etudes, de Realisations et d'Applications Techniques, Paris, France

[21] Appl. No.: 767,974

[22] Filed: Aug. 21, 1985

[30] Foreign Application Priority Data

Aug. 21, 1984 [FR] France ..... 84 13015

[51] Int. Cl.[4] ..... F42B 11/22; F42B 13/02; F42B 1/00

[52] U.S. Cl. ..... 102/309; 102/476

[58] Field of Search ..... 102/305-310, 102/475, 476

[56] References Cited

U.S. PATENT DOCUMENTS

| | | | |
|---|---|---|---|
| 3,100,445 | 8/1963 | Poulter | 102/309 |
| 3,136,249 | 6/1964 | Poulter | 102/309 |
| 3,451,339 | 6/1969 | Precoul | 102/476 |
| 3,561,361 | 2/1971 | Kessenich et al. | 102/307 |
| 3,662,684 | 5/1972 | Bodinaux | 102/476 |
| 3,732,816 | 5/1973 | Muller | 102/306 |
| 3,802,342 | 4/1974 | Berlot | 102/309 |
| 4,436,033 | 3/1984 | Precoul | 102/310 |

FOREIGN PATENT DOCUMENTS

| | | | |
|---|---|---|---|
| 91860 | 10/1983 | European Pat. Off. | 102/309 |
| 1811331 | 6/1970 | Fed. Rep. of Germany | 102/476 |
| 2525763 | 10/1983 | France | 102/476 |
| 2039008 | 7/1980 | United Kingdom | 102/476 |

OTHER PUBLICATIONS

Encyclopedia of Explosives and Related Items, PATR 2700, vol. 8, U.S. Army, ARRADCoM, Dover, NJ, 1978, pp. 06-017.

*Primary Examiner*—Harold J. Tudor

*Attorney, Agent, or Firm*—Wenderoth, Lind & Ponack

[57] ABSTRACT

A hollow charge including a primer block with a reverse, integrated ogival screen with a triggering effect.

19 Claims, 9 Drawing Figures

HOLLOW CHARGES

BACKGROUND OF THE INVENTION

1. Field of the Invention

The present invention relates to improvements in hollow charges.

Due to the evolution of armorings for an ever more effective protection of combat tanks, notably by composite assemblies composed of several layers of different materials, inert or active, there has been development aimed at increased performance of hollow charges.

2. Background of the Invention

The level reached today, in 1984, of piercing armor of 7 to 8 calibers on an armored steel target is still insufficient. The present invention proposes several improvements to hollow charges allowing reaching the objective of perforating steel armors of at least 10 calibers.

It is known by experience (checked by informatics calculations) that the vertex of a conical liner having a very closed or acute vertex angle (for example 30–35° and in any case <40°) produces very high speeds for the head of the jet, all the more important as the vertex angle is smaller.

However, the perforation level of the hollow charge does not depend only on the speed of the jet head. To obtain the maximum efficiency of the hollow charge against armor plates, especially composite plates having inert or active layers, it is preferable that the liner be made of copper or other materials according to the invention, such as tantalum for example, and the liner should have a wider angle at the front or base thereof. Suitable profiles of the liner can be ogival or arch shaped, inflected, with multiple slopes, etc.

But on the one hand, for maintaining the jet speed within physically reasonable limits, according to the material used (this higher speed limit is of about 10,000 m/s for copper), that is for preventing the disruption of the jet formed, which would be contrary to the object in view, a dosage of the thicknesses of the wall is accomplished according to the invention as a function of the angle and of the fraction or portion of liner and of its estimated position in the jet; the result is, for the rear portion of the liner according to the invention, adapted wall thickness laws of the liner: a degressive thickness, a progressive-constant thickness, a constant-degressive thickness, etc.

On the other hand, it should be remembered that the "tail" elements of the jet have third origin at the base of the liner. The speed of such elements is between 2,000 and 4,000 m/s. The diameter of said elements is important and many of them do not take part in the penetration since any slight deviation to which they are possibly subjected during their formation directs them to the edge of the crater formed by the elements of the jet head.

SUMMARY OF THE INVENTION

In order to improve the perforating power due to said elements, it is notably important to increase their speed by increasing their mass, and therefore their diameter.

The result is therefore, according to the invention, a new thickness relationship for the liner walls, progressing from the vertex, then constant or even degressive to the base of said liner.

Moreover, in order to fully and completely act on the jet and on its formation at the front of the charge and of the liner, and to avoid the "edge" effects of the liner, the present invention has as an object thereof a cylindrical charge and filler charge, allowing in fact regulating and optimizing a primer block, whatever it may be, forming a sub-assembly as such, placed at the rear of a main explosive filler charge, and allowing an optimum adaptation of $h_4$ (the axial distance between the liner vertex and the vertex of the front part of a shield) and obtaining a homogeneous and isotropic filler charge, obtained by forced casting (Octolite for example) or by an isostatic compression of a powerful explosive.

According to the present invention, various primers can be combined with liners having different profiles which will be described hereinafter.

According to the invention, there is first proposed a primer block with a plane front face and provided with an integral ogival (arch shaped) shield having a triggering effect, reversed with the arch thereof facing away from the liner, of great height, said primer block being made of a powerful explosive, for example Octowax (Octogen and wax), the primer detonation waves being oriented according to the invention by the integrated reversed ogival shield, made of cork for example.

The primer block and its integrated, reversed shield, thereby form according to the invention an assembly which is directly applied against the rear plane face of the main explosive. The latter is therefore not hollowed, according to the invention, for receiving the shield, resulting in very many advantages concerning the surface states, the precision, the geometry, the flatness, the perpendicularity and finally the symmetry, which are favorable for the perforating power.

According to an alternative embodiment, the invention proposes a primer block having an ogival shield fitted in a recess in the primer block. The primer block can be made as a thick disc, of great diameter and from a material such as Octowax for example, the primer block detonation waves being pre-oriented by the triggering effect of the ogival shield according to the invention, which can be made of cork for example.

According to another variant of the invention, there is proposed a primer block made as a thick disc of great diameter, with a semi-ogival shield having a triggering effect fitted in a recess in the primer block, the latter being made of Octowax for example. The primer block detonation waves are pre-oriented by said semi-ogival shield, made for example of cork, of large diameter so as to "apply", according to the invention, the detonation wave on the liner vertex and thereby provide an increase of power to the jet head.

The invention proposes also the application of a primer block with a plane wave generator ("P.W.G.") composed of three successive layers of explosive (a composite explosive for example, based on Octogen) of judiciously chosen shapes and thicknesses, forming according to the invention a thick cylindrical disc and the main characteristic of which is the formation, at the outlet, of a plane and symmetrical detonation wave, the "edge" effects being corrected at the start during designing and by the setting of the adjustment.

Finally, the invention proposes the application (yet in a non limiting manner) of a primer block with a plane wave generator by increasing the thickness of one layer and decreasing the thickness of an adjacent layer along the axial direction towards the liner.

The original concave shape of one layer is defined in order to obtain a rigorously constant plane detonation wave during detonation of the primer block so as to initiate, in a rigorously symmetrical manner, the detonating of the main explosive charge.

The object of the present invention is therefore various improvements to hollow charges, notably for weapon systems such as rocket launchers, missiles, mortars, closed-breech guns, recoilless guns, rifles, grenades, heads with multiple elements, subammunition, mines, etc., notably characterized in that said hollow charge, of a general cylindrical shape, including the primer block, is provided, in order to avoid the "edge" effects, with a liner of conical shape, with a "closed" or acute vertex angle (<60 and preferably <40). Said liner which is conical at the vertex can then, without departing from the scope of the invention, assume an inflected shape, or an ogival shape. The thickness relationship of said liner according to the invention is starting from the vertex, degressive (decreasing) or progressive-constant (incresaing then constant) or constant-degressive (constant then decreasing). Said dispositions according to the invention are of course provided in combination with primer blocks having various designs.

The various features and advantages of the invention will become more apparent from the following description, which relates to a head with a hollow charge.

It should be noted that the following description relates to examples and that any other embodiments, proportions, dispositions, combinations can be used without departing from the scope of the invention.

In the following description, reference will be made to the accompanying drawings in which all the figures are sectional longitudinal views of a head with a hollow charge according to the invention.

DETAILED DESCRIPTION OF THE PREFERRED EMBODIMENTS

Figure 1:
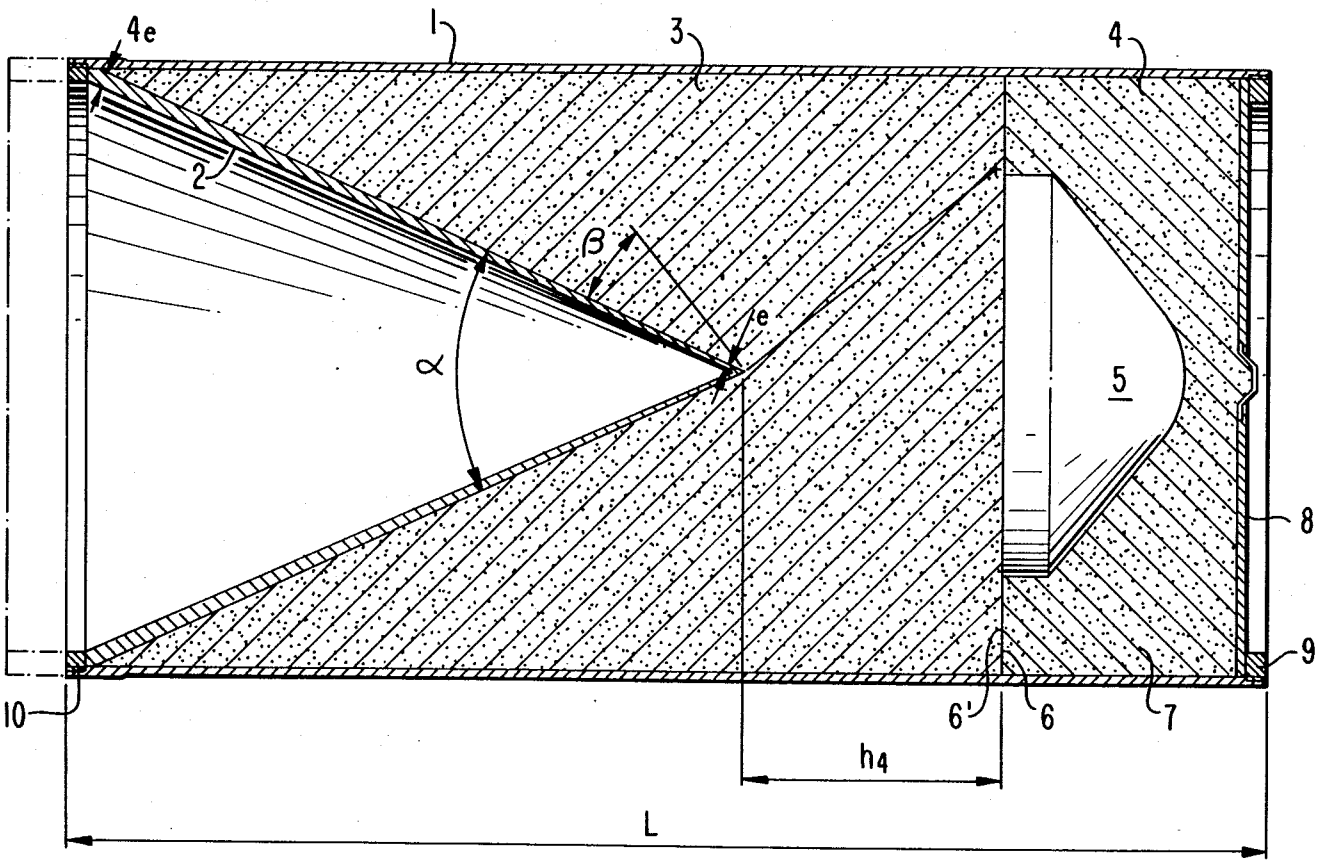
FIG. 1 shows a cylindrical hollow charge according to the invention, provided with a conical liner having a closed or acute vertex angle (50° for example) of progressive thickness and with a cylindrical primer block with an integrated reversed ogival shield according to the invention.

Reference being first made to FIG. 1, a description is given of the aforementioned dispositions, characteristic of the invention, applied to a hollow charge.

A body or casing 1 of the present invention has a cylindrical shape which has a central axis extending in an axial direction and the casing is, preferably, made of a light alloy or of a resin-glass or also fiber-resin wound complex. The cylindrical shape according to the invention, which reduces the "edge" effect, allows production of a winding of any nature without difficulty.

The casing 1 has coaxially disposed therein a liner 2. The liner 2 having a conical profile, is made of copper, which may or may not be annealed or of any other material, such as tantalum for example, having a relatively closed or acute vertex angle ($\alpha < 50°$), and a progressive thickness. The ratio in progressive change in the thickness of liner 2 is 4:1, for example, from the vertex to the base of the liner (the thickness of the liner being e at the vertex and 4e at the base, thus the thickness is four times greater at the base than at the vertex of the liner).

The casing 1 has coaxially disposed therein a main filler charge 3 which is made of a powerful known explosive obtained by isostatic compression of a "forced" cast explosive (Octolite 85/15 for example).

The casing 1 also has disposed therein a primer block 4 with the main charge 3 disposed between the liner and the primer block 4. The primer block 4, according to the characteristics of the invention, is a thick cylindrical disc, with an ogival shaped recess or indentation cut therein for receipt of a reversed integrated ogival (arch shaped) shield 5, which extends into part of the primer block 4. The primer block 4 is of explosive material, such as Octowax for example. The primer block detonation waves are pre-oriented by the reversed integrated ogival shield 5, which has a triggering effect and is made of cork for example.

The front surface 6 of the primer block on the side of the main explosive is flat and thus lies in a plane which is perpendicular to the axial direction of the casing 1 and the ogival shield 5 is fitted in a recess on the surface 6 such that the shield 5 is flush with and has a maximum diameter at the surface 6 and the ogival shape of the shield 5 extends into the primer block 4.

The primer block 4 and its integrated shield 5 form a monoblock subassembly 7 which is spaced axially further from the base than the vertex of the liner and which abuts or is applied directly against a plane containing a flat rear face 6' of the main explosive 3, the face 6' being perpendicular to the axial direction of the casing 1. The latter is therefore not hollowed for receiving the shield 5.

A detonation distance $h_4$ is set according to the invention in order to obtain an optimum angle $\beta$ for the inclination of the detonation wave generated by said primer block.

Closing rings or plates 8, 9, 10 complete the construction of the assembly of the cylindrical charge according to the invention.

Figure 2:
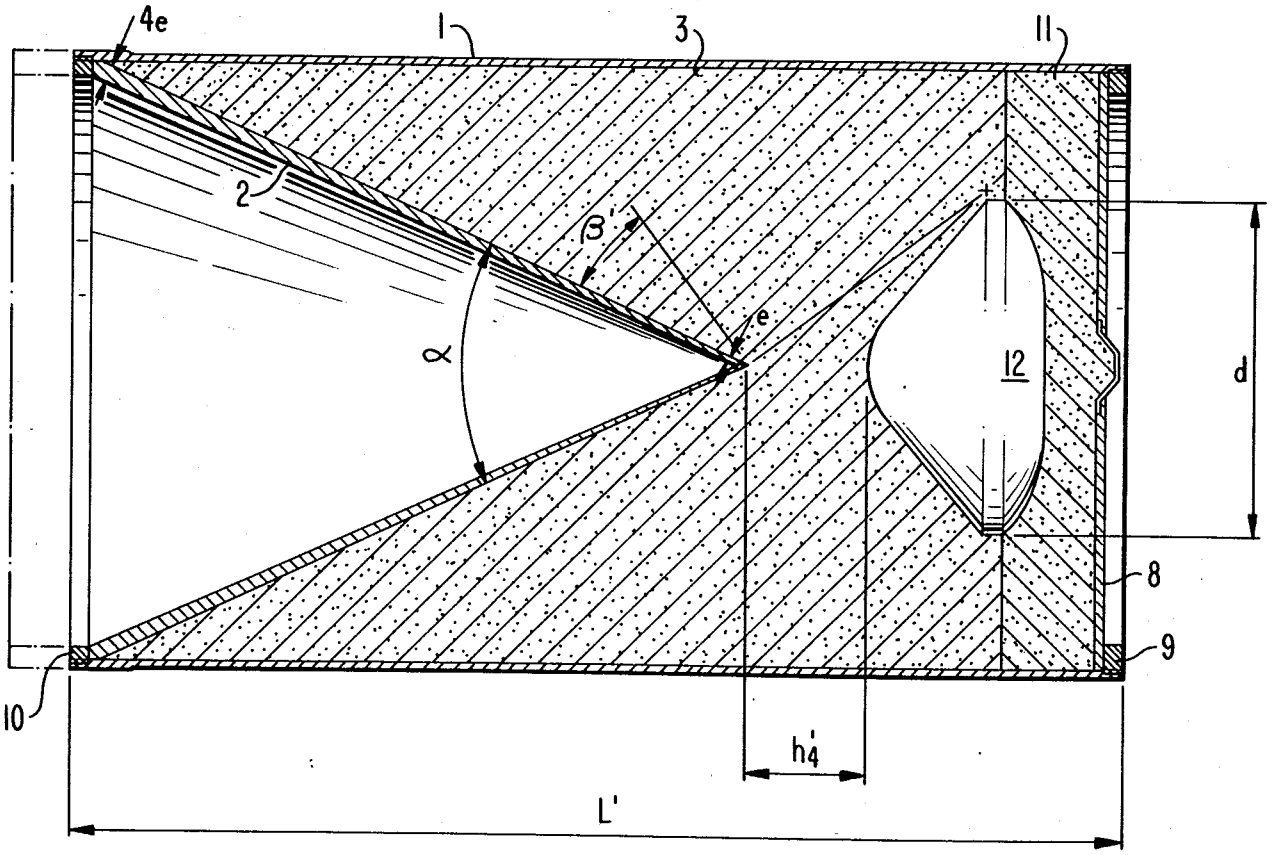
FIG. 2 shows a cylindrical hollow charge according to the invention, provided with a conical liner having an acute or closed vertex angle (50° for example) of progressive thickness and a primer block with an "ogival" shield with a triggering effect.

FIG. 2 shows the same hollow charge according to the invention as that shown in FIG. 1 and including the same constituent elements, but in which the monoblock subassembly 7 containing an integrated reversed ogival shield has been replaced by a primer block 11 according to the invention, made of a thick disc with a recess or indentation therein, formed of Octowax for example. The primer detonation waves are pre-oriented by an ogival shield 12, having a triggering effect, made of cork, and having a diameter d, which is fitted in the recess formed in the primer block 11 but with the ogival shape extending into a recess formed in the main explosive charge 3.

The detonation distance is $h'_4 < h_4$ (FIG. 1) in that case, and the inclination angle of the detonation wave generated by the primer block 11 remains $\beta' \approx \beta$.

Figure 3:
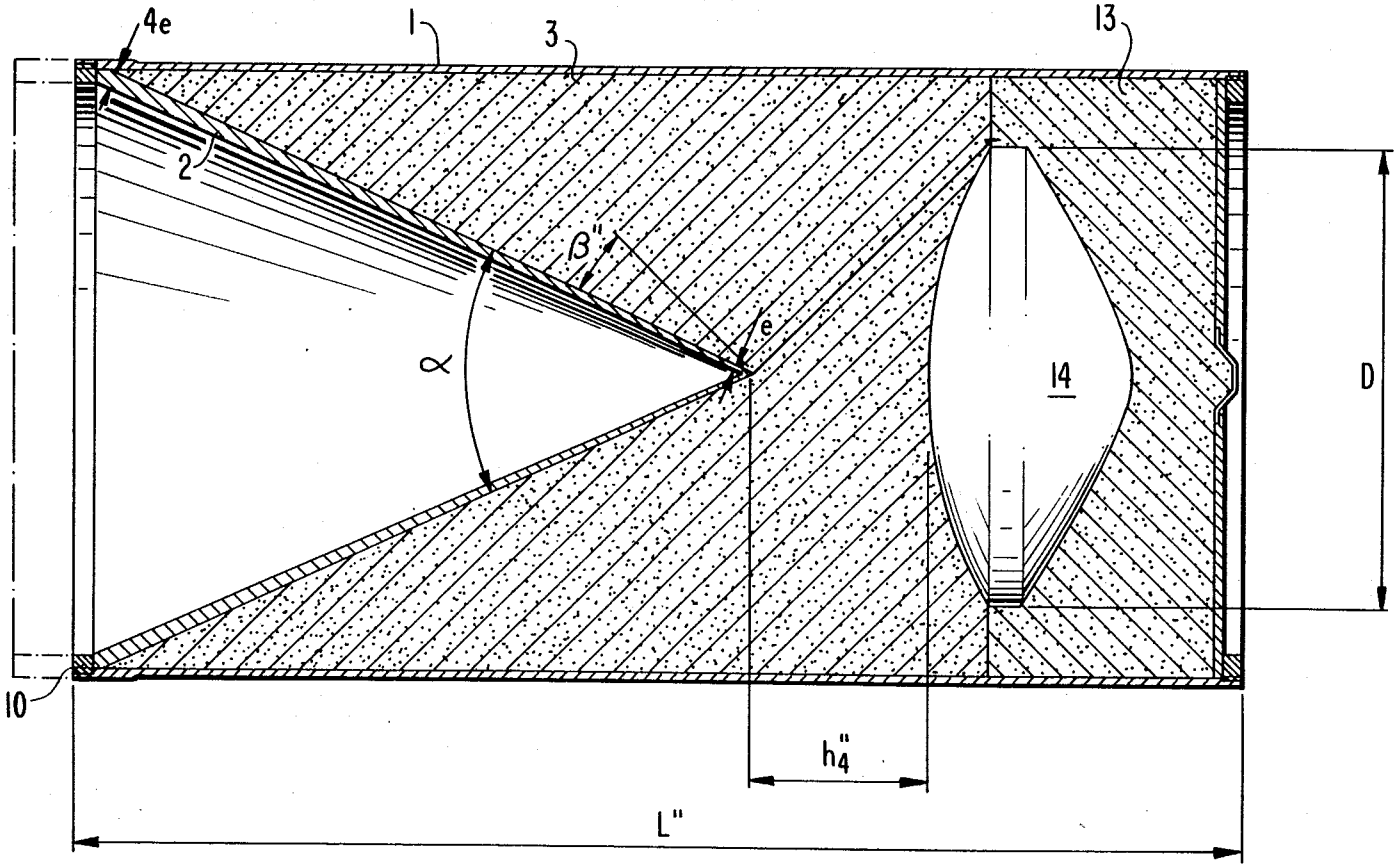
FIG. 3 shows a cylindrical hollow charge according to the invention, provided with a conical liner having an acute or closed vertex angle (50° for example) of progressive thickness and a cylindrical primer block with a semi-ogival shield according to the invention.

FIG. 3 still shows the same definition of the hollow charge according to the invention and according to FIGS. 1 and 2, but in which the monoblock subassembly 7 of FIG. 1 has been replaced by a primer block 13 made of a thick disc with a recess or indentation formed therein, and made for example of Octowax. The primer block detonation waves are pre-oriented according to the invention by a semi-ogival shield 14, made of cork for example, having a large diameter D (D>d of FIG. 2) and having a triggering effect, in order to "apply" the detonation wave on the vertex of the liner at an inclination angle of detonation $\beta''$ ($\beta'' < \beta$ and $\beta'$, FIGS. 1 and 2) and thereby providing an increase of power at the head of the jet. The semi-ogival shield 14 includes a portion extending into a recess formed in the main charge 3, with the portion of the shield located closest to the liner 2 determining a detonation distance $h''_4$, which is less than the distance between the vertex of the liner and the primer block 13.

Said distances $h_4$, $h'_4$, $h''_4$ of FIGS. 1, 2 and 3 lead to adapted lengths L, L', L'' of the casing.

The hereinabove descriptions made with reference to FIGS. 1, 2 and 3 all relate to alternative embodiments of the cylindrical charge according to the invention, with a conical liner of "closed" or having an acute angle and progressive thickness, with a ratio of 4:1 for example.

Figure 4:
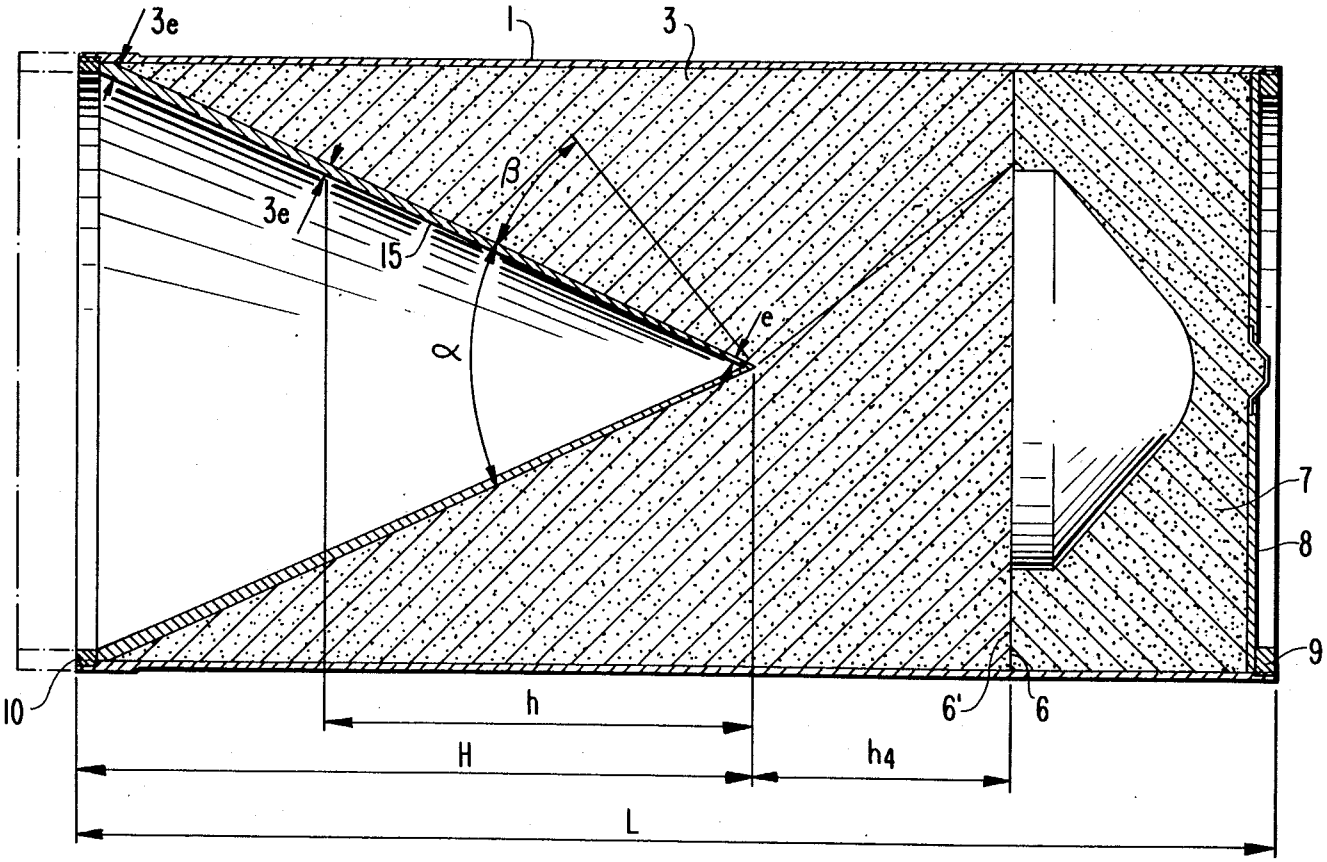
FIG. 4 shows a cylindrical hollow charge according to the invention, provided with a conical liner having an acute or closed vertex angle (50° for example) of constant-progressive thickness and a primer block with an integrated reversed ogival sheld.
Figure 5:
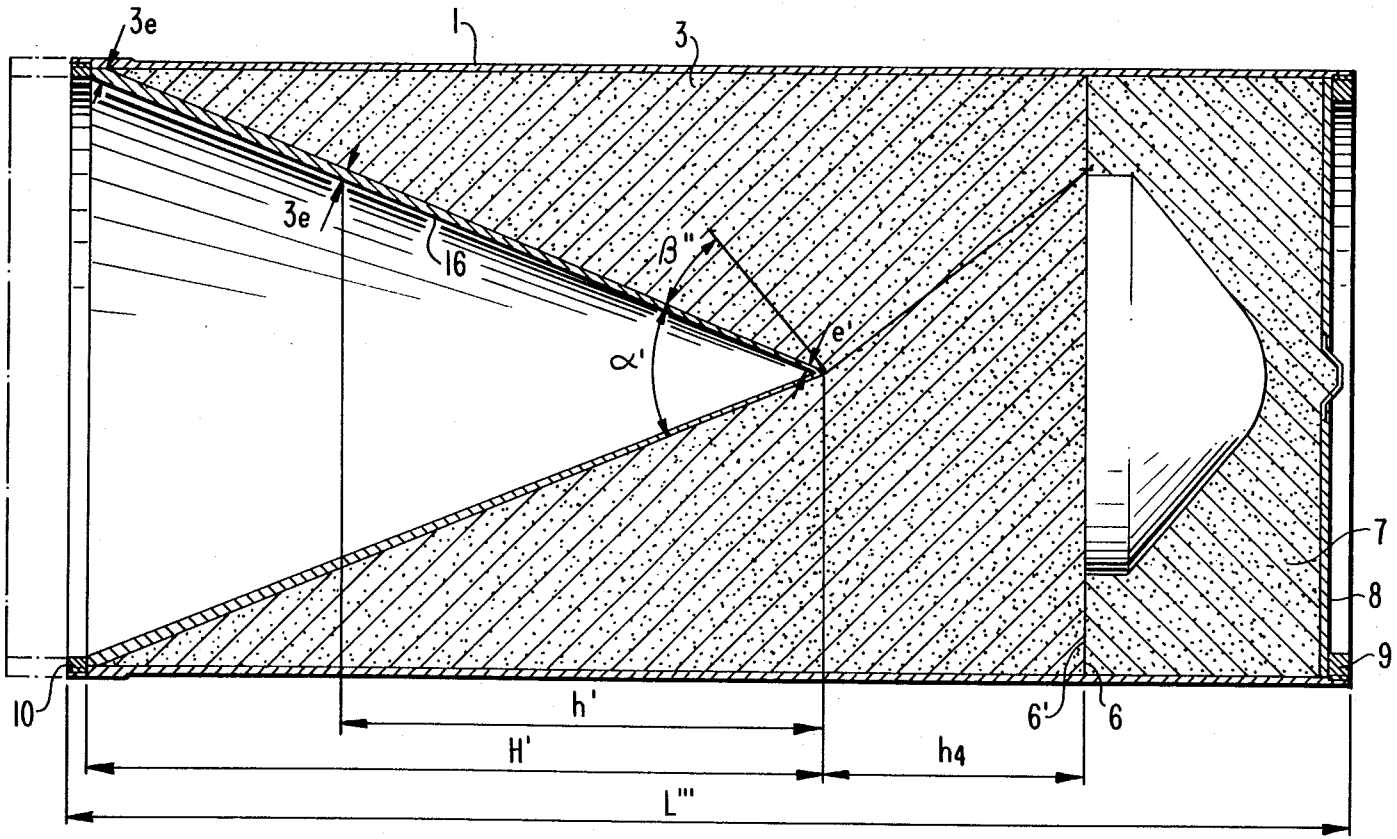
FIG. 5 shows a cylindrical hollow charge according to the invention, provided with a conical liner having an acute or closed vertex angle (45° for example) of constant-progressive thickness according to the invention, and primer block of which is with an integrated reversed ogival shield according to the invention.

FIGS. 4 and 5 which are described hereinafter refer to two complementary alternative embodiments of the cylindrical charge according to the invention, with a conical liner.

FIG. 4 takes into account the aforementioned disposition, notably due to the fact that the jet elements coming from the base of the liner are relatively slow and of large diameters, and therefore do not totally take part in the penetration, any eventual deviation causing their impact to be on the edge of the crater.

According to the invention, the variant proposed by said FIG. 4 has all the elements of FIG. 1, notably the monoblock subassembly 7 with an integrated reversed ogival shield, but the relationship of the variation in the liner thickness which is first progressive, for example with a ratio of 4:1, if one considers the totality of its height H, is subjected to a modification when its thickness reaches for example the value of 3 e, corresponding to a portion of the liner or a height h equal to $\frac{2}{3}$ of total height H of the liner.

Thus, and according to the invention, the elements of the jet tail ($\frac{1}{3}$ of its height) generated according to the invention by a fraction of the liner which has become less thick compared to the embodiments shown in FIGS. 1-3 and is therefore lighter (around the base), are allowed to move faster and to better "cling" to the jet head and more rapid anterior portion, and follow them.

The cylindrical charge according to the invention, shown in FIG. 5, is only different from that of FIG. 4 by the smaller value of angle $\alpha'$ (45 for example) of liner 16, the thickness of said liner being progressive-constant, with the same dispositions as that shown in FIG. 4.

The length L''' of the casing 1 is adapted to the greatest height H' of liner 16, due to its smaller vertex angle.

Figure 6:
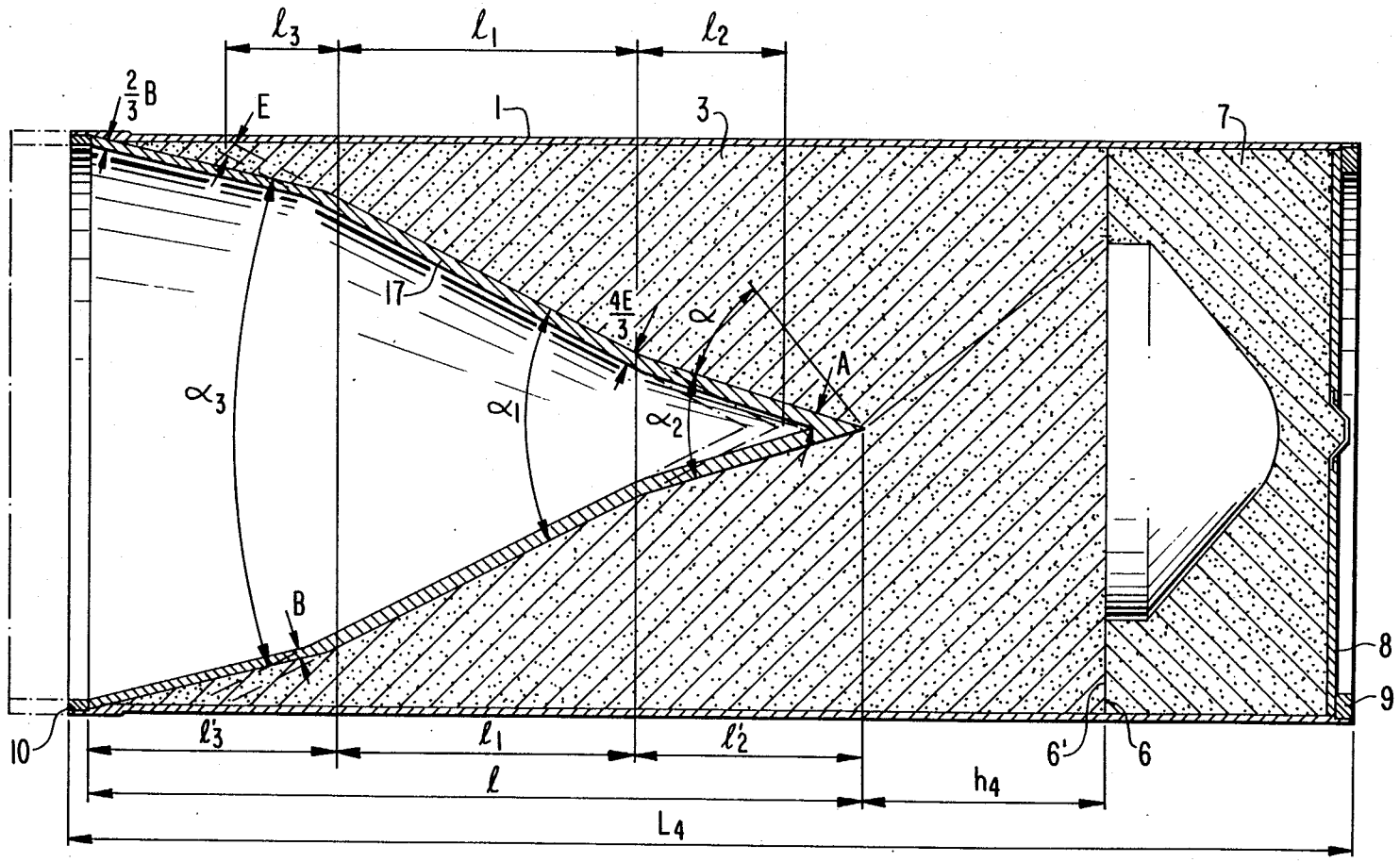
FIG. 6 shows a cylindrical hollow charge according to the invention, provided with an inflected liner according to the invention, of constant and then degressive-constant thickness and with an integrated reversed ogival shield according to the invention.

FIG. 6 shows a cylindrical hollow charge according to the invention, provided with an inflected liner 17.

According to the invention, the liner 17 is generated from a conical profile of constant angle $\alpha_1$ (55 for example) provided with three slopes by a modification of the angles at the two ends. In the drawing, said generating liner 17 is shown in phantom. The general relationship of the thickness of the conical generating liner 17 is linearly degressive according to invention (4E/3) at the vertex, E at the base for example).

In order to increase the speed and mass of the jet elements, as will be explained hereafter, the liner shape is modified by starting from the generating liner 17. To this effect, said generating liner is geometrically divided into three portions of lengths $l_1$, $l_2$, $l_3$, the length of the central portion $l_1$ being preferably the most important.

In the portion of length $l_2$, at the vertex, the value of angle $\alpha_1$ is reduced to a value $\alpha_2$ ($\alpha_2$ less than $\alpha_1$ and equal to 35° for example) while the liner thickness is kept constant in this portion, said thickness A corresponding to the local thickness of the generating liner portion situated in the rear slice of portion of length $l_1$, the relationship of the thickness of said liner being linearly degressive, as discussed hereinabove (for example (4E/3) at its vertex and E at its base).

In the portion opposite the base, of length $l_3$, the value of angle $\alpha_1$ is reduced to a value $\alpha_3$ less than $\alpha_1$ and also less than $\alpha_2$ ($\alpha_3 = 25°$ for example). The relationship of the thickness of said portion opposite the base is linearly degressive, the thickness being at the rear of the length $l_3$ a value B corresponding to the local thickness of the generating liner portion situated in the front slice of its portion of length $l_1$, and at the front of the length $l_3$ a thickness equal for example to $\frac{2}{3}$B.

Under such conditions,the length of the new liner thus obtained is $l_1 + l'_2 + l'_3 > l_1 + l_2 + l_3$.

In all cases, the connecting radii of the conical portions in broken lines, which are obtained according to the invention by the process just indicated, are determined according to the invention by taking care that the center of the connecting radius is actually situated on the bisectrix of the generating angles formed at each change of slope and also being careful to respect this positioning relationship when the walls are not parallel.

Due to this disposition according to the invention, the inflected liner just described allows obtaining a maximum energy of the liner by a modulation of the angle-thickness couples, while respecting the speed physical limit allowing the material to support it without causing disruption of the jet.

The cylindrical charge just described, with an inflected liner, uses on the other hand the other means described previously: main explosive filler charge, primer, etc.

Figure 7:
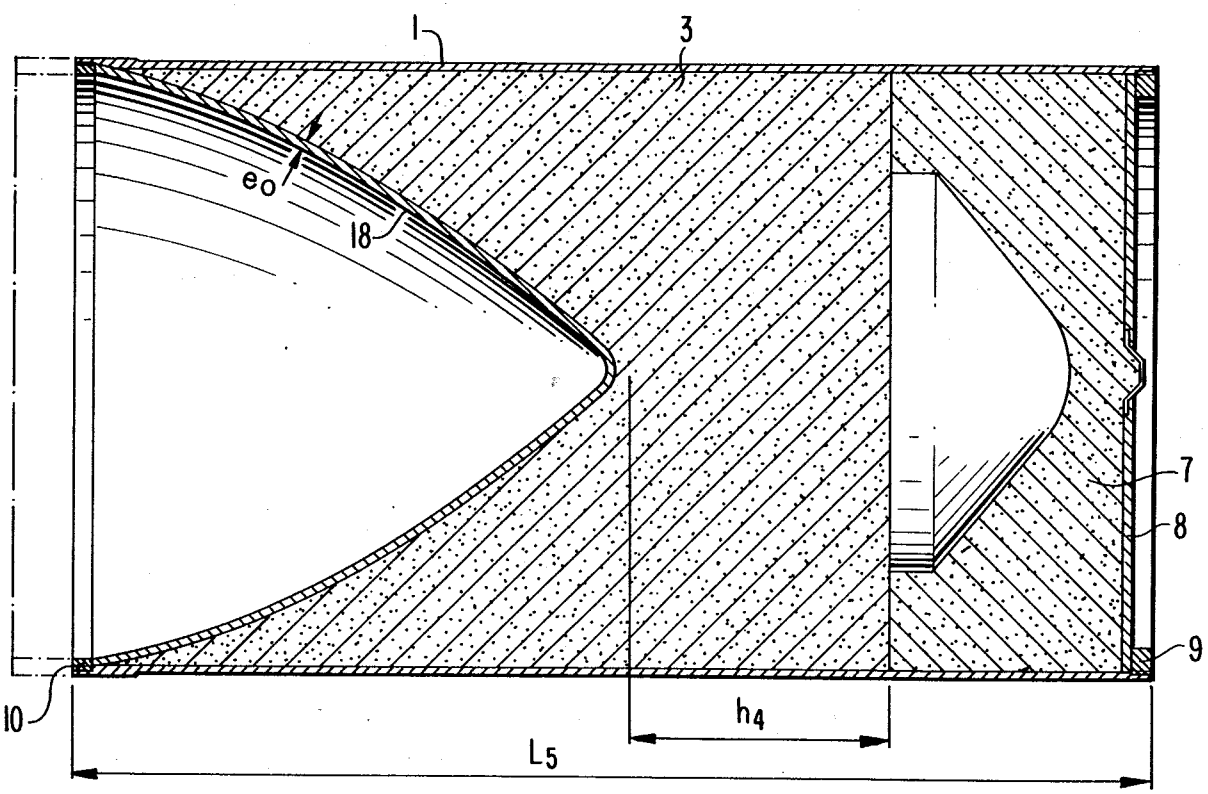
FIG. 7 shows a cylindrical hollow charge according to the invention, provided with a ogival liner of constant thickness and with a primer block with an integrated reversed ogival shield.
Figure 8:
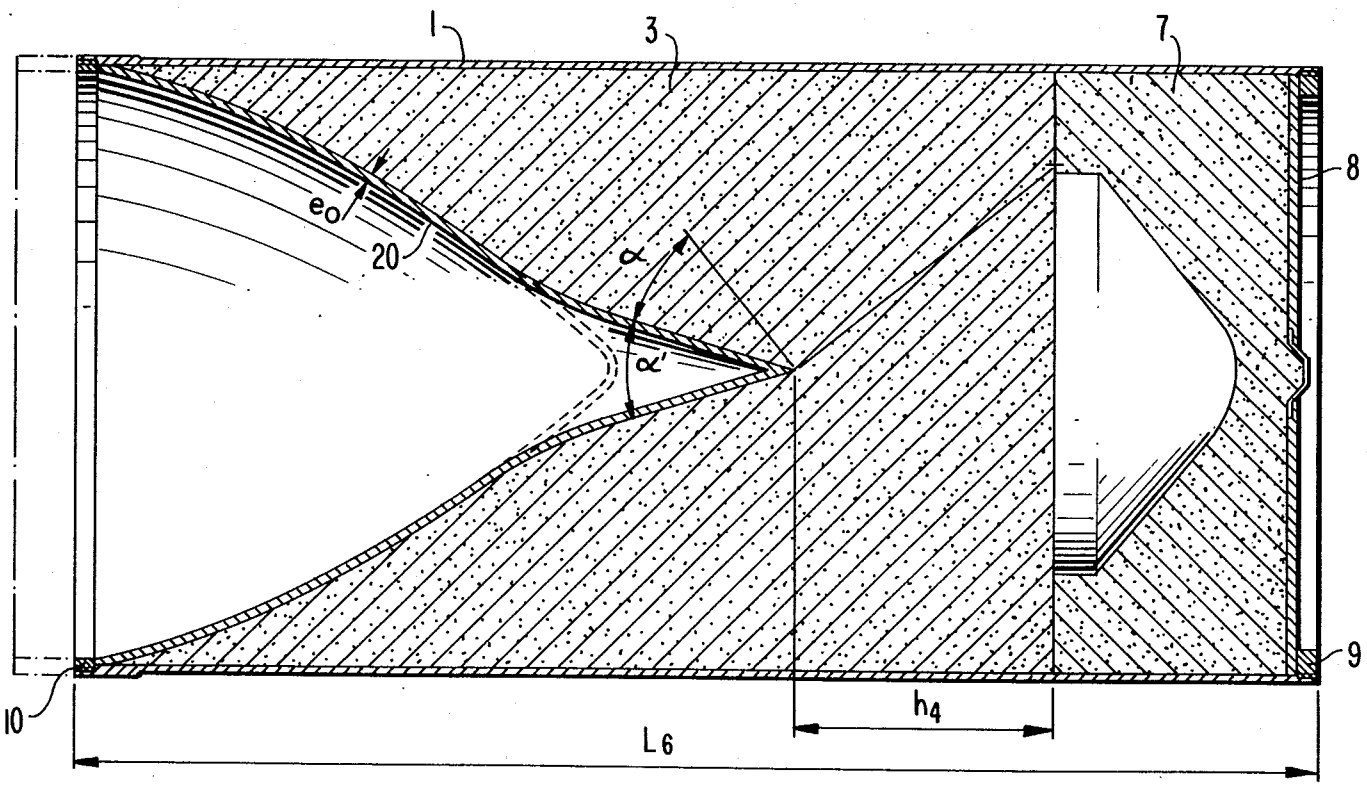
FIG. 8 shows a cylindrical hollow charge according to the invention, provided with a liner of constant thickness, the conical vertex of which, having an acute or closed vertex angle (<40° for example), assumes from then on an ogival shape and is provided with a primer block with an integrated reversed ogival shield.

FIGS. 7 and 8 show a cylindrical hollow charge according to the invention, provided with a primer or a liner according to the present invention, with an acute or closed vertex angle (<40° for example) combined with a liner of ogival type already proposed by the assignee of the present invention in its French Pat. No. 77 35482 of Nov. 11, 1977.

FIG. 8 shows, according to the invention, a cylindrical hollow charge with a conical liner, having a vertex angle $\alpha'$ less than 40° (for example 35°) and of constant thickness $e_o$, to which has been adapted, in the prolongation of the conical shape which has been kept for the vertex, an ogival shape 20 with a thickness $e_o$ always constant.

Thus and according to the invention, the perforating power is increased by increasing the speed of the jet head.

Figure 9:
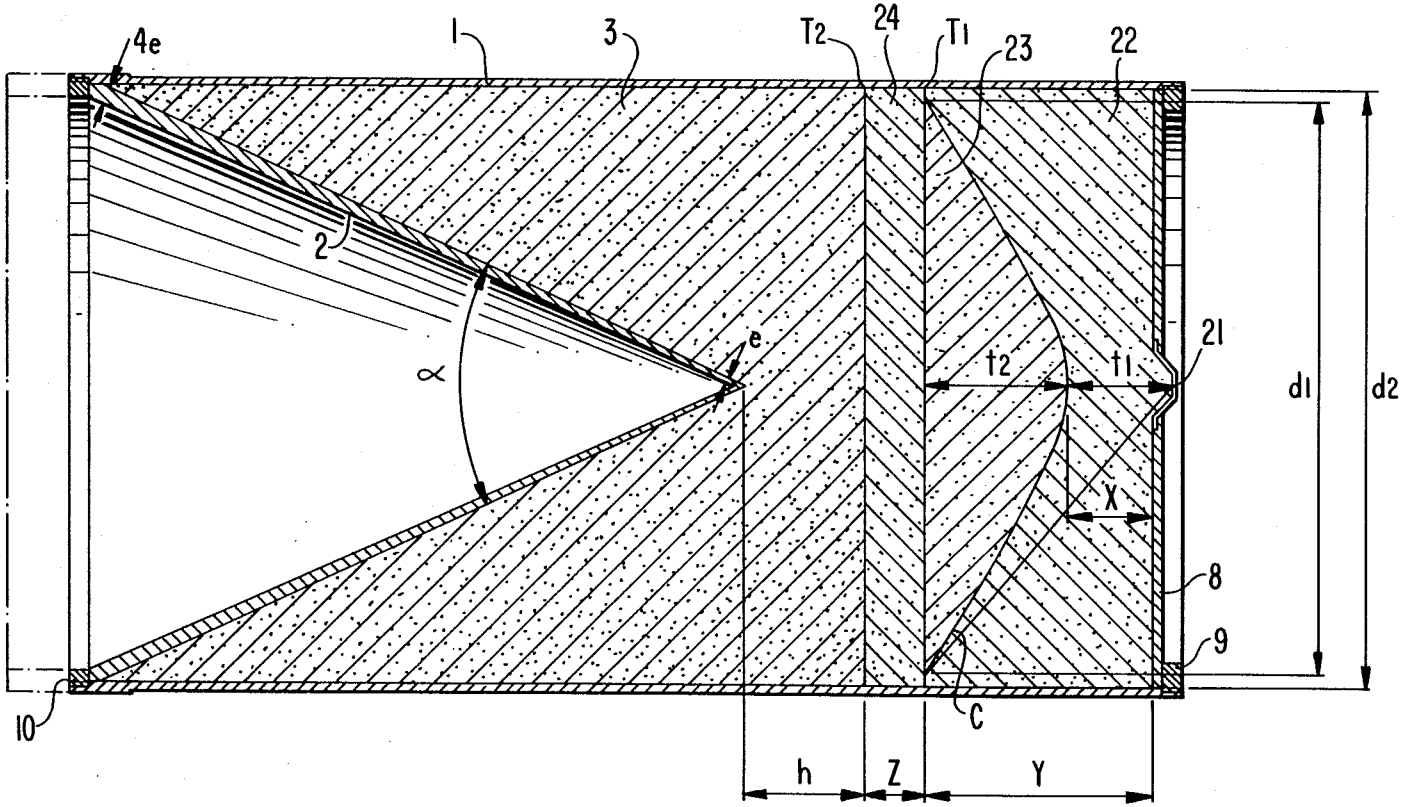
FIG. 9 shows a cylindrical hollow charge according to the invention, provided with a conical liner having an acute or closed vertex angle (50° for example) of progresive thickness and with a plane wave generating primer block.

FIG. 9 shows a cylindrical hollow charge according to the invention with a conical liner of progressive thickness but provided according to the invention with a primer block made of a plane wave generator ("P.W.G.").

Said plane wave generator can be made for example of three explosive layers 22, 23, 24 the detonation speeds of which are different so as to provide the constancy of the travel times of the detonation wave of the primer block assembly from the initiation point 21 (t1+t2=the distance from point 21 to a plane T, between layers 23 and 24 being constant in all paths). The shape C, the heights x and y, of the two main blocks 22 and 23, which can be an ogival shaped block 23 fitted in a recess of a cylindrical block 22, and the nature of the explosives chosen provide said constancy. Such dispositions are well known of those skilled in the art.

Shape C has a front diameter d1 smaller than the diameter d2 of the inside of the hollow charge body, in order to limit the disturbing edge effects of the wave flatness of the detonation wave at the outlet of a plane T2 between the mainexplosive charge 3 and the layer 24.

We claim:

1. A hollow charge, comprising:

a casing having a cylindrical shape and extending in an axial direction;

a liner coaxially disposed within said casing, said liner having a conical configuration with a vertex of said liner positioned centrally within said casing, said liner having a progressive thickness between a base thereof and said vertex, said thickness being greater at said base than at said vertex of said liner;

a monoblock subassembly coaxially disposed within said casing and spaced axially further from said base than from said vertex of said liner, said monoblock subassembly including a cylindrical primer block of explosive material and an inverted shield fitted in a recess on a surface of said primer block facing said liner, said inverted shield having a maximum diameter at said surface of said primer block and having an ogival shape extending into part of said primer block; and a main explosive charge disposed in said casing between said liner and said monoblock subassembly;

whereby said ogival shield provides a triggering effect assuring preorientation of detonation waves generated by said primer block and an angle of the detonation waves striking said liner can be adjusted by changing the axial distance between said monoblock subassembly and said vertex of said liner.

2. The hollow charge of claim 1, wherein said surface of said primer block lies in a plane which is perpendicular to said axial direction and said ogival shield is flush with said surface of said primer block, said surface abutting a surface of said main charge which is also perpendicular to said axial direction.

3. The hollow charge of claim 1, wherein said primer block is of a powerful explosive.

4. The hollow charge of claim 3, wherein said powerful explosive is of Octowax.

5. The hollow charge of claim 1 wherein said ogival shield is of a low-density material.

6. The hollow charge of claim 5 wherein said low density material is cork.

7. The hollow charge of claim 1, wherein said primer block is of a powerful explosive and said ogival shield is of a low density material.

8. The hollow charge of claim 1 wherein said primer block is of Octawax and said ogival shield is of cork.

9. The hollow charge of claim 1, wherein said main charge is of a homogeneous and isotropic explosive.

10. The hollow charge of claim 9, wherein said main charge is a forcibly cast charge of the octolite type of explosive.

11. The hollow charge of claim 9, wherein said main charge is an isostatically compressed powerful explosive.

12. The hollow charge of claim 1, wherein the thickness of said liner at said base is four times greater than the thickness of said vertex.

13. The hollow charge of claim 1, wherein the thickness of said liner at said base is three times greater than the thickness of said vertex.

14. The hollow charge of claim 1, wherein said shield includes a portion extending into said main charge, whereby a detonation distance between said vertex of said liner and said shield is less than the distance between said shield and said primer block.

15. The hollow charge of claim 1, wherein said liner includes a portion of constant thickness between said base and said vertex of said liner.

16. The hollow charge of claim 15 wherein said portion comprises one-third of the axial length of said liner.

17. The hollow charge of claim 16, wherein said portion extends from said base of said liner.

18. The hollow charge of claim 1, wherein said liner has a vertex angle which is an acute angle.

19. The hollow charge of claim 1 wherein said vertex angle is less than or equal to 50.

* * * * *